US005813928A

United States Patent [19]

Hsieh

[11] Patent Number: 5,813,928

[45] Date of Patent: Sep. 29, 1998

[54] BALL BASKET

[76] Inventor: Frank Hsieh, 9th-1 Floor, Kuang Fu South Road, Taipel, Taiwan

[21] Appl. No.: 769,134

[22] Filed: Dec. 18, 1996

[51] Int. Cl.[6] ..... A63B 63/08

[52] U.S. Cl. ..... 473/480

[58] Field of Search ..... 473/480

[56] References Cited

U.S. PATENT DOCUMENTS

| | | | |
|---|---|---|---|
| 1,980,652 | 11/1934 | Wiezel et al. | 473/480 |
| 2,061,152 | 11/1936 | Guthrie | 473/480 |
| 2,413,952 | 1/1947 | Chervenka | 473/480 |
| 2,593,758 | 4/1952 | Holmdahl | 473/480 |
| 5,064,195 | 11/1991 | McMahan et al. | 473/480 |

*Primary Examiner*—William H. Grieb
*Attorney, Agent, or Firm*—Browdy and Neimark

[57] ABSTRACT

A ball basket comprises an attachment loop, a net and a sensing unit. The net is fastened at one end thereof with the attachment loop which is in turn fastened with a goal frame. The sensing unit is composed of a connection string and a sensing body connected with the connection string fastened with the net. The sensing body is provided with an oscillatory power switch for controlling an audio-photo element capable of bringing about an audio-photo effect at such time when the sensing body is impacted by a ball.

5 Claims, 4 Drawing Sheets

BALL BASKET

FIELD OF THE INVENTION

The present invention relates generally to an exercise equipment, and more particularly to a high-tech ball basket.

BACKGROUND OF THE INVENTION

The conventional ball basket is composed of an attachment ring and a net fastened with the attachment ring, and is devoid of a device capable of generating an audio or visual response at such time when a ball is sent through the net. The conventional ball basket is therefore monotonous at best.

SUMMARY OF THE INVENTION

It is therefore the primary objective of the present invention to provide a ball basket capable of generating an audio or visual response at the time when a ball is sent through the net of the ball basket.

It is another objective of the present invention to provide a high-tech bass basket, which is simple in construction and cost-effective.

It keeping with the principle of the present invention, the foregoing objectives of the present invention are attained by a ball basket, which comprises an attachment loop, a net, and a sensing unit. The net is fastened at one end thereof with the attachment loop which is in turn fastened with a goal frame. The sensing unit is secured to the net and is composed of a sensing body having an oscillatory power switch for controlling an audio-photo element capable of bringing about an audio-photo effect at the time when the sensing body is impacted by a ball.

The foregoing objectives, features and functions of the present invention will be more readily understood upon a thoughtful deliberation of the following detailed description of the embodiments of the present invention in conjunction with the accompanying drawings.

DETAILED DESCRIPTION OF THE INVENTION

Figure 1:
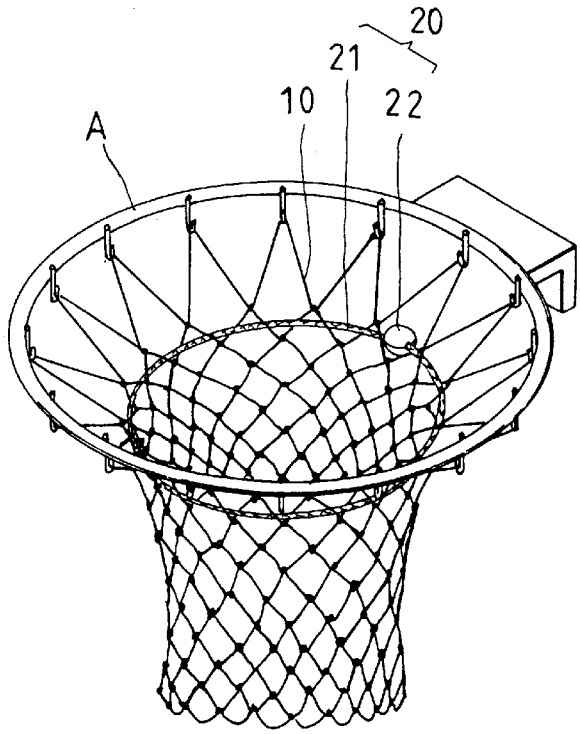
FIG. 1 shows a perspective view of a first preferred embodiment of the present invention.
Figure 2:
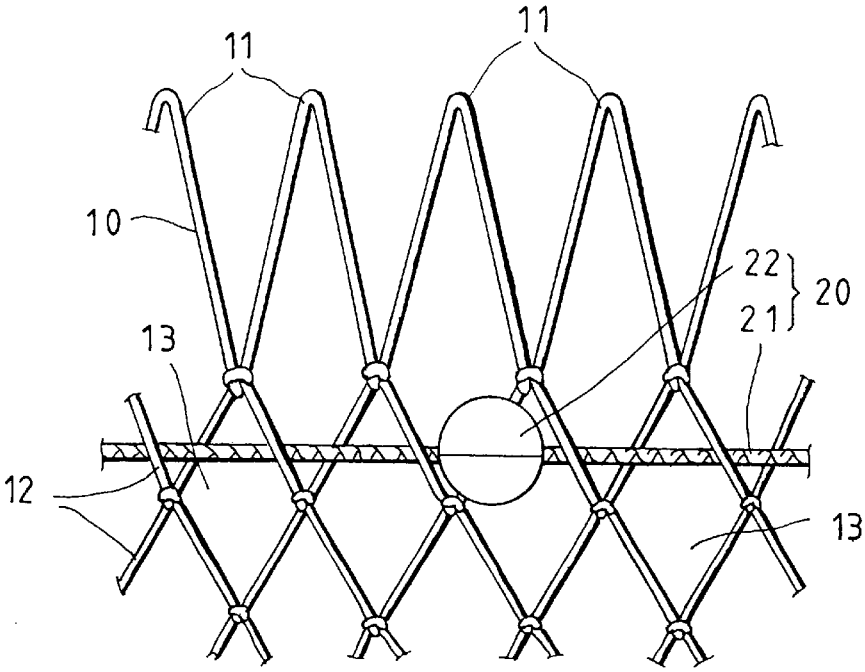
FIG. 2 is a partial plan view illustrating the way that the sensing unit is fastened with the net of the first preferred embodiment as shown in FIG. 1.

As shown in FIGS. 1-4, a ball basket of the first preferred embodiment of the present invention comprises an attachment loop "A", a net 10, and a sensing unit 20.

The net 10 is provided at the upper side thereof with a plurality of attachment hooks 11 which are secured to the attachment loop "A", which is in turn fastened with a goal frame. The net 10 is composed of a plurality of cords 12 loosely woven in an openwork pattern for catching a ball.

The net 10 is further composed of a plurality of meshes 13 formed by the loosely woven cords 12.

The sensing unit 20 comprises a connection string 21 and a sensing body 22. The connection string 21 is located at the junction between the upper segment of the net 10 and the lower segment of the net 10, as shown in FIG. 1. The upper segment of the net 10 is greater in diameter than the lower segment of the net 10. The sensing body 22 is held by the connection string 21. The circular junction, where the connection string 21 is located, has a radius RA slightly greater than the radius R'A of a ball, as illustrated in FIG., 4.

Figure 3:
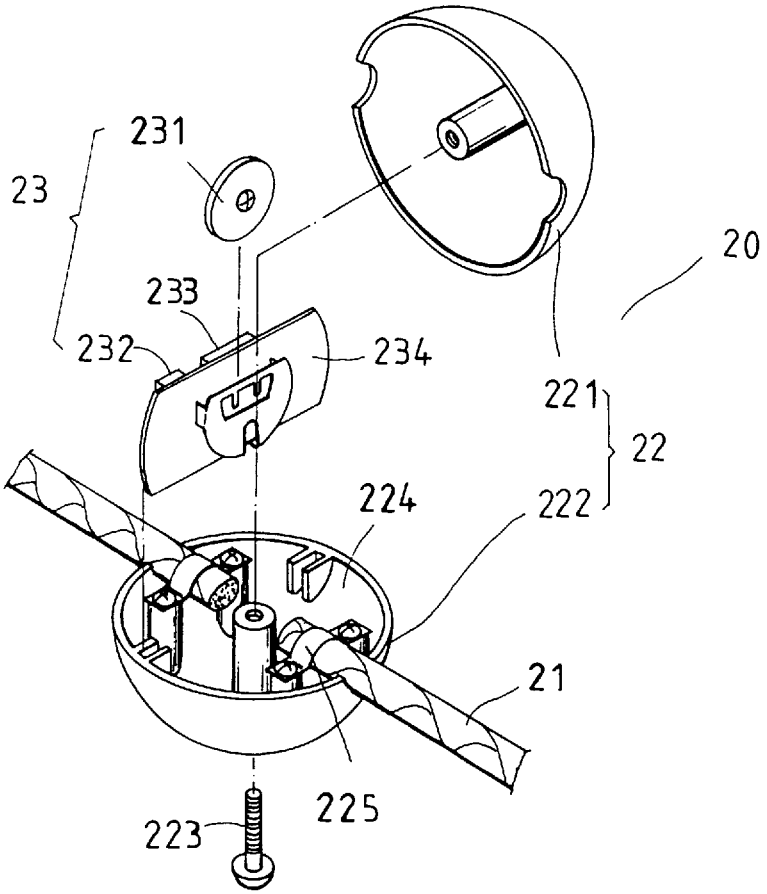
FIG. 3 shows an exploded view of the sensing unit of the first preferred embodiment of the present invention.

As shown in FIG. 3, the sensing body 22 is composed of an upper housing 221 and a lower housing 222, which are held together by a fastening screw 223. The sensing body 22 is of a hollow construction and is provided therein with a receiving cell 224 in which an electronic member 23 is housed. The lower housing 222 is provided therein with two retaining pieces 222 opposite in location to each other for engaging with the connection string 21. The electronic member 23 is composed of a battery 231, an oscillatory power switch 232, an audio-photo element 233, and a circuit board 234. The oscillatory power switch 232 may be a ball-type switch or a spring-type switch. The audio-photo element 233 may be a voice integrated circuit, a light-emitting diode (LED), a light bulb, etc. The audio-photo element 233 is capable of bringing about an audio-photo effect at such time when the sensing body 22 is impacted by a ball designated by the letter "D" in FIG. 3.

Figure 4:
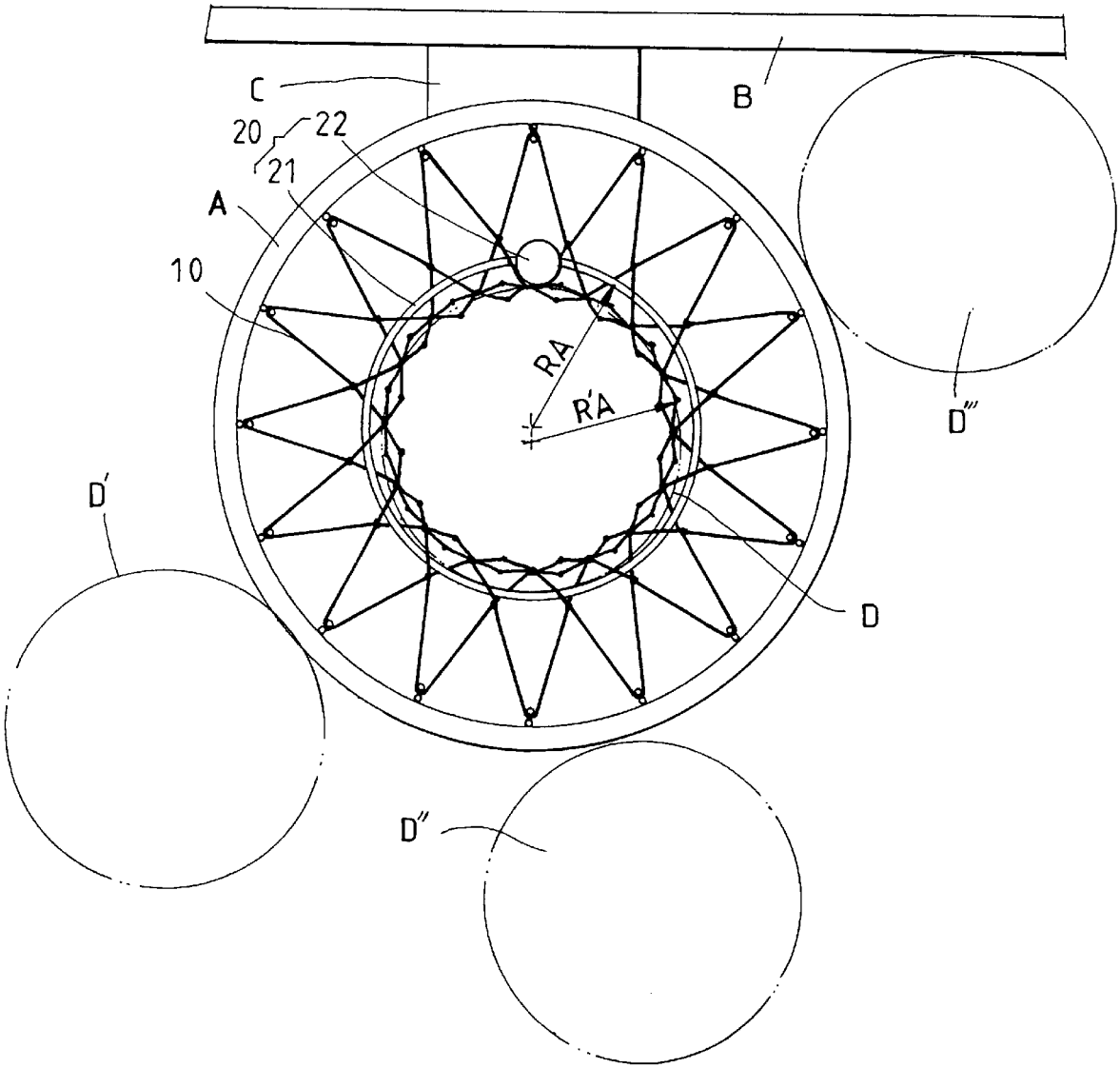
FIG. 4 shows a top view of the first preferred embodiment as shown in FIG. 1.
Figure 5:
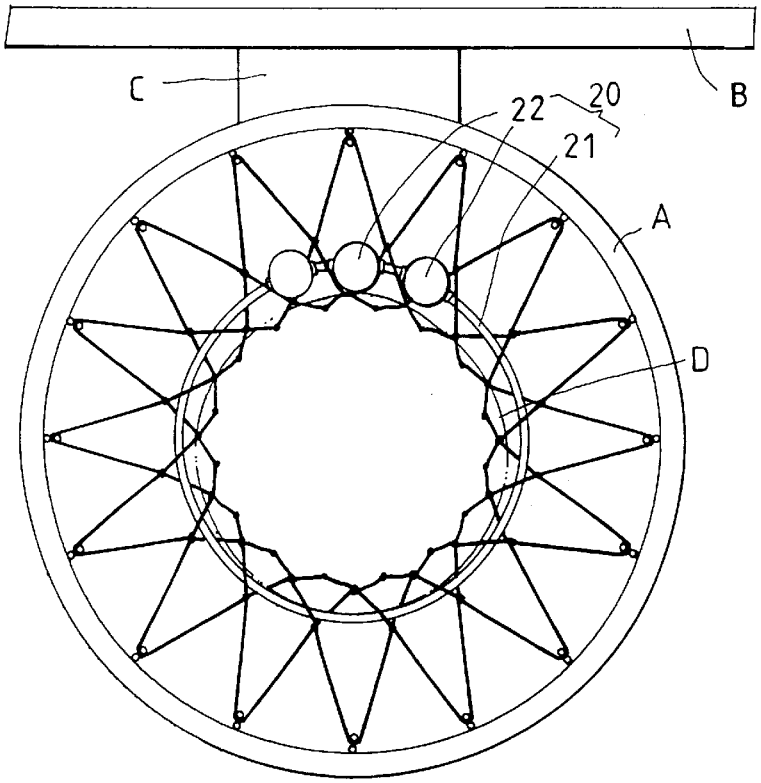
FIG. 5 shows a top view of a second preferred embodiment of the present invention.

As illustrated in FIGS. 4 and 5, the sensing body 22 of the present invention is preferably proximal to a goal frame "B". In addition, the connection board "C", to which the attachment loop "A" is fastened, has a length smaller than the diameter of the ball "D" so as to prevent the balls "D'", "D"", and "D""", which are not caught by the net 10 of the present invention, from triggering the sensing body 22.

If the sensing body 22 is a light-emitting body, the upper housing 221 and the lower housing 222 of the sensing body 22 should be made of a transparent or translucent material. The sensing body 22 may be provided with the circuits connected in series for bringing about the photo effect and the audio effect in sequence. The diameter of the junction of the net 10, which the sensing unit 20 is located, can be adjusted by the length of the connection string 21.

Figure 6:
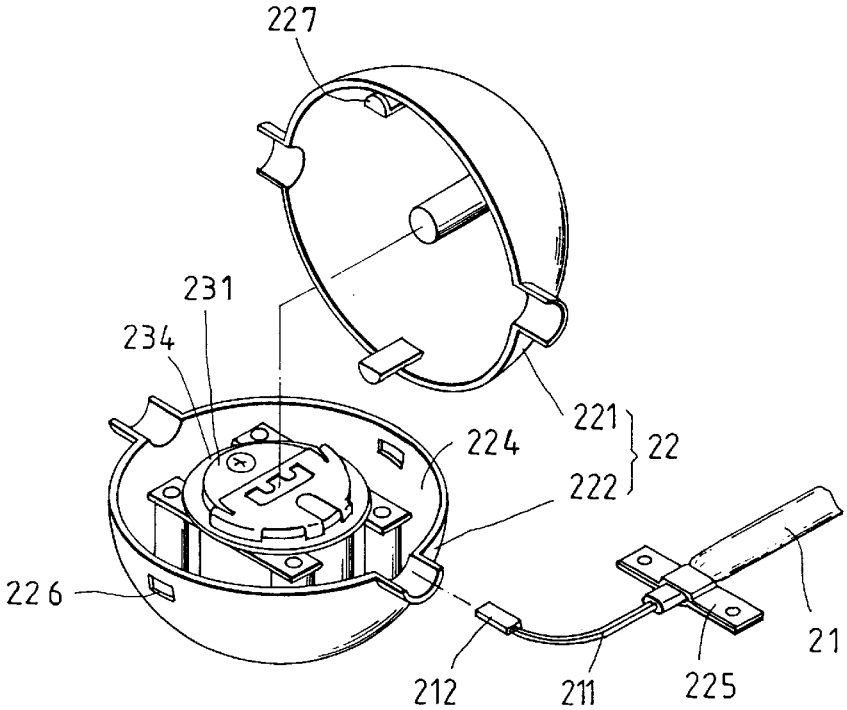
FIG. 6 shows an exploded view of the sensing unit of a third preferred embodiment of the present invention.

The embodiments of the present invention described above are to be regarded in all respects as being merely illustrative and not restrictive. Accordingly, the present invention may be embodied in other specific forms without deviating from the spirit thereof. For example, the sensing unit 20 of the present invention may be composed of a plurality of independent sensing bodies 22, as shown in FIG. 5. The sensing bodies 22 are provided respectively with an independent circuit and are so located that they are proximal to the goal frame "B". In addition, if sensing bodies 22 are provided with circuits connected in series, as illustrated in FIG. 6, the connection string 21 is provided with a circuit 211 sheathed thereby. The circuit 211 is connected with two terminals 212, with one of the terminals 212 being fastened with a horizontal circuit board 234 of the one of the sensing bodies 22 and with another one of the terminals 212 being fastening with the circuit board of the adjoining sensing body 22. Moreover, the upper housing 221 and the lower housing 222 of the sensing body 22 are held together by a plurality of tenons 227 of the upper housing 221 and a plurality of mortises 226 of the lower housing 222. The present invention is therefore to be limited only by the scopes of the following appended claims.

What is claimed is:

1. A ball basket comprising:

an attachment loop fastened with a goal frame;

a net formed of a plurality of loosely woven cords and meshes formed by said woven cords, said net fastened at one end thereof with said attachment loop such that said net is composed of one segment proximal to said attachment loop, another segment distal to said attachment loop, and a junction located between said one segment and said another segment such that said junction has a diameter greater than the diameter of a ball, and that said junction is provided with a connection string fastened therewith; and a sensing unit fastened with said connection string of said junction of said net and provided with a sensing body housing therein an electronic member, said electronic member being composed of an oscillatory power switch and an audio-photo element capable of bringing about an audio-photo effect at such time when said oscillatory power switch is turned on by an impact of the ball making contact with said sensing body.

2. The ball basket as defined in claim 1, wherein said audio-photo element is a voice integrated circuit.

3. The ball basket as defined in claim 1, wherein said audio-photo element is a light-emitting body; and wherein said sensing body has a housing made of a transparent or translucent material.

4. The ball basket as defined in claim 1, wherein said sensing unit comprises a plurality of sensing bodies which are independent of one another and are connected in series with said connection string.

5. The ball basket as defined in claim 4, wherein said connection string is provided with a circuit sheathed thereby such that said circuit is connected in series with said sensing bodies.

* * * * *